US005434609A

United States Patent [19]

Rhodes

[11] Patent Number: 5,434,609

[45] Date of Patent: Jul. 18, 1995

[54] DEFLECTION SYSTEM FOR DEFLECTING CHARGED PARTICLES

[75] Inventor: Paul M. Rhodes, Cambridgeshire, Great Britain

[73] Assignee: Linx Printing Technologies PLC, England

[21] Appl. No.: 794,113

[22] Filed: Nov. 15, 1991

[30] Foreign Application Priority Data

Nov. 21, 1990 [GB] United Kingdom ..... 9025273

[51] Int. Cl.[6] ..... B41J 2/09

[52] U.S. Cl. ..... 347/77; 347/73

[58] Field of Search ..... 347/73, 77

[56] References Cited

U.S. PATENT DOCUMENTS

| | | | |
|---|---|---|---|
| 3,895,386 | 7/1975 | Keur et al. | 347/77 |
| 4,122,458 | 10/1978 | Paranjpe | 347/77 |
| 4,596,990 | 6/1986 | Hou | 347/73 X |

FOREIGN PATENT DOCUMENTS

| | | | |
|---|---|---|---|
| 0042049 | 12/1981 | European Pat. Off. | 347/77 |
| 59-068252 | 4/1984 | Japan . | |
| 61-227060 | 10/1986 | Japan | 347/77 |
| 525000 | 8/1940 | United Kingdom . | |
| 1250645 | 10/1971 | United Kingdom . | |
| 1420256 | 1/1976 | United Kingdom . | |
| 1507753 | 4/1978 | United Kingdom . | |
| 2010746 | 7/1979 | United Kingdom . | |
| 2117965 | 10/1983 | United Kingdom . | |

OTHER PUBLICATIONS

IBM Technical Disclosure Bulletin, West & Williams, "Ink Jet Deflection Plate Arrangement", vol. 15, No. 2, Jul. 1972.

European Search Report.

*Primary Examiner*—William J. Royer

*Attorney, Agent, or Firm*—Lerner, David, Littenberg, Krumholz & Mentlik

[57] ABSTRACT

A deflection arrangement for deflecting charged particles, e.g. ink drops in an ink jet printer, is arranged so that the potential dropped across an air gap between deflection electrodes varies with position along the air gap. This may be achieved by providing a varying thickness of dielectric material 31 on one deflection electrode 29, extending towards the other deflection electrode 27. Preferably, the width of the air gap varies to follow the fanning out of the paths of differently deflected particles (e.g. ink drops), and the variation in the potential across the air gap allows advantage to be taken of the fact that the dielectric strength (breakdown field strength) of air varies with the width of the air gap.

9 Claims, 2 Drawing Sheets

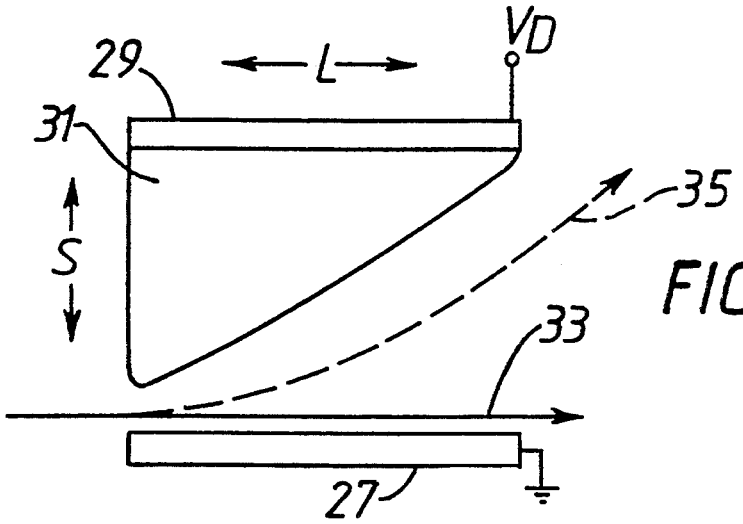
FIG. 3
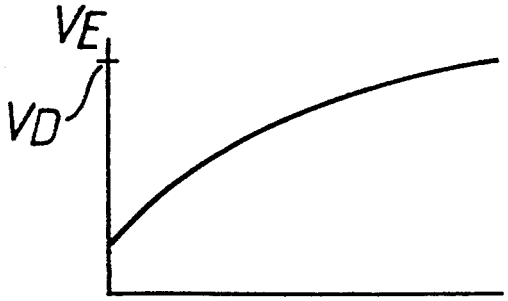
FIG. 4
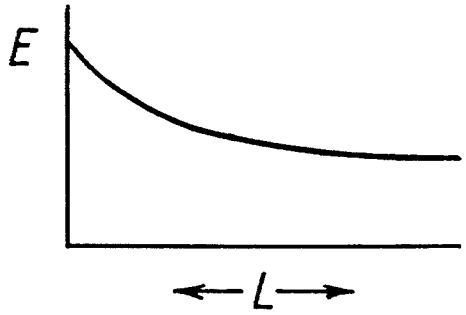
FIG. 5
FIG. 6
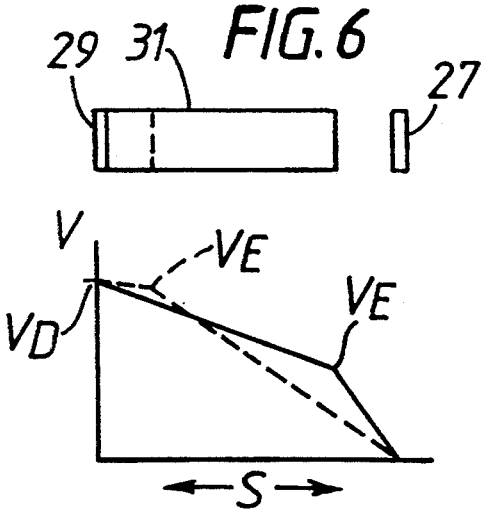
FIG. 7
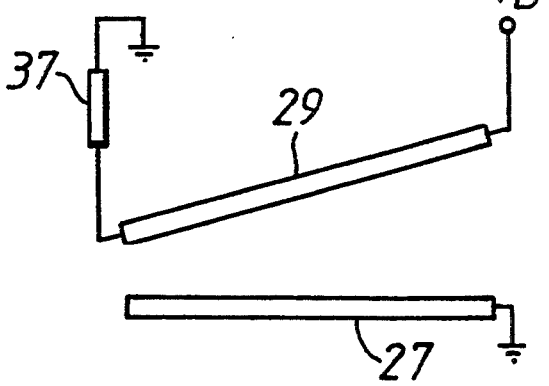

DEFLECTION SYSTEM FOR DEFLECTING CHARGED PARTICLES

The present invention relates to the electrostatic deflection of charged particles passing through a gaseous medium. The charged particles may be liquid drops. An example of an apparatus which, in use, deflects charged liquid drops electrostatically is an ink jet printer, and the invention will be described in terms of its application to an ink jet printer, but the present invention is not limited thereto.

In an ink jet printer, drops of ink are propelled past deflection electrodes towards a recording medium, such as paper. Provision is made to charge the ink drops electrically, and respective voltages are applied to the deflection electrodes so as to create an electric field between them. The charged ink drops are deflected as they pass through the electric field, each being deflected to a degree corresponding approximately to the level of charge on it. In this way, each drop is directed to a chosen position on the recording medium, or alternatively may be directed into a gutter which collects it and returns the ink to a reservoir.

An arrangement is known from U.S. Pat. No. 4,122,458 of Paranjpe in which a deflection electrode is divided into a plurality of electrode portions spaced in the direction of movement of the ink drops. The voltage for each electrode portion is switched independently so that a charged drop either is or is not deflected by each electrode portion depending on whether the deflection voltage is applied to the respective electrode portion. The value of the deflection voltage applied to an electrode portion is adjusted to select the desired angle of deflection of an ink drop by that electrode portion. This arrangement is relatively unusual in that all the drops are charged to the same level and the deflection field is switched to determine the angle of deflection. It is more common to provide a constant deflection field and vary the charge on the drops in accordance with the desired angle of deflection.

Most ink jet printers fall into one of two types: continuous ink jet printers; and drop-on-demand printers. In a continuous ink jet printer, drops of ink are provided continuously, and passed to the gutter when it is desired that they should not reach the recording medium. In a drop-on-demand printer, drops are normally provided only when they are wanted to mark the recording medium. The present invention relates to both types of ink jet printer, as well as to other devices which deflect charged particles.

For a given charge on a ink drop or other particle, the stronger the electric field is between the deflection plates the more quickly the ink drop or other particle is deflected. However, there are practical limits on the strength of the field which can be provided between the deflection electrodes, and in particular care must be taken to ensure that the field does not reach the breakdown field strength for the air gap between them. Generally, designers of ink jet printers work on the assumption that the electrical breakdown field strength of air is about 3 kV per mm, and select the separation between the deflection electrodes and the voltages applied to them so as to ensure that the electric field between them remains below this value by a suitable margin.

However, the dielectric strength of air is not in fact a constant value, but increases as the width of the air gap across which the electric field is applied decreases.

Accordingly, according to an aspect of the present invention there is provided a deflection arrangement for charged particles having deflection electrodes with an air gap between them which at least at one point is no greater than 4 mm wide. More preferably, the minimum width of the air gap is no greater than the 3 mm, and most preferably it is no greater than 2 mm. The minimum width of the air gap may be as small as 0.5 mm, or even less, although normally it will be more than 0.5 mm. Where the apparatus is an ink jet printer or a device operating in a similar manner, the minimum air gap width is preferably similar to the gap in the charge electrode through which the drops pass.

As the air gap decreases from 4 mm, particularly when it is below 3 mm, the breakdown electric field strength of air is significantly greater than for larger air gaps. The effect is particularly marked for gaps of less than 2.5 mm. Below 1.5 mm the breakdown field strength rises sharply with decreasing air gap.

Accordingly, by using a narrow air gap between the deflection electrodes, it is possible to provide a stronger deflection field without dielectric breakdown of the air, and accordingly the charged particles may be deflected more sharply.

In use of an ink jet printer, some drops are normally deflected more than others, to provide a printing raster. This is achieved by charging different drops by different amounts, in accordance with the degree of deflection required. Accordingly, as soon as the drops enter the field between the deflection electrodes, the paths of differently charged drops will begin to diverge. Consequently, if the deflection electrodes extend in the direction of the ink drop paths over any distance, care must be taken to ensure that they are spaced apart far enough to accommodate all the divergent ink drop paths between them, without any of the drops colliding with one of the electrodes.

Since the different ink drop paths will be spread further apart with greater distance along the paths, it is known e.g. from PCT specification WO 89/03768, to provide deflection electrodes which are angled relative to each other, at least over a part of their length. At the up stream end of the deflection electrodes, they are closer together to maximise the deflection field, and at the down stream end they are further apart to accommodate the divergent ink drop paths. This arrangement enables a relatively high field to be provided at the up stream end of the electrodes, so as to begin to separate the different ink drop paths as soon as possible, while allowing a relatively low deflection electrode voltage to be used. However, it has the consequence that the electric field between the down stream ends of the electrodes is relatively weak.

A uniform high field strength can be obtained by providing the deflection electrodes parallel to each other and spaced apart to accommodate all the divergent ink drop paths, with a sufficiently high voltage between them. However, this means that the electric field must remain lower, by the chosen margin of safety, than the breakdown electric field over this relatively large air gap. Thus, the field at the up stream end of the electrodes cannot be as high as the field which could be used if the electrodes where closer together. Although the electric breakdown field strength increases as the air gap is decreased, the breakdown voltage across the gap decreases as the gap decreases. Therefore, it is not possible to provide the maximum safe field strength between the electrodes both at their up stream end and their down stream end by choosing an appropriate angle between the electrodes.

Accordingly, an aspect of the present invention provides deflection electrodes for deflecting charged particles in which there is an air gap between the deflection electrodes to accommodate the paths of the particles, the potential difference across the air gap being different at different positions along its length. Preferably, the width of the air gap is also different at different positions along its length.

One way of providing the varying potential difference across the air gap is to use a deflection electrode having a high resistance, with different voltages applied to its respective ends, so that the electric potential in the electrode varies along its length. However, it is preferred to provide a region of a dielectric material between one of the deflection electrodes and the air gap, the electrical permittivity of the material and/or its thickness varying with position along the air gap, and its permittivity being different from that of air. This enables the electric potential at the edge of the dielectric material remote from the deflection electrode to vary with position along the air gap.

Typically, the width of the air gap and the electric potential dropped across it will be chosen at all points to provide an electric field across the air gap which is a selected margin of safety below the breakdown field for the width of the air gap at that point. The margin of safety may be the same proportion of the field strength or may be the same amount of electric potential for all positions along the air gap, but this is not necessarily the case. Additionally, it may be necessary, particularly at the up stream end of the air gap, to take into account the width of the ink drops or other charged particles. Since ink drops are typically electrically conducting, the effective width of the air gap across which the electric potential is dropped is reduced when an ink drop passes through the air gap. In some types of ink jet printer, the ink drops may be as much as 0.2 mm in diameter, which would represent a significant reduction in the width of an air gap of 1 or 1.5 mm.

Preferably, the edge of the air gap is aligned with the path of the maximally deflected charged particle, with a suitable margin between them to ensure that the maximally deflected particle does not collide with the edge of the air gap.

Embodiments of the present invention, given by way of non-limiting example, will now be described with reference to the accompanying drawings, in which:

FIG. 3 shows a first embodiment of the present invention;

FIG. 4 is a graph of the electric potential at one edge of the air gap against position along the air gap in the embodiment of FIG. 3;

FIG. 5 is a graph of electric field strength in the air gap against position along the air gap in the embodiment of FIG. 3;

FIG. 6 is a graph of electric potential with position between the electrodes in the embodiment of FIG. 3;

FIG. 7 shows a second embodiment of the present invention, and

FIGS. 1 and 2 show the operative components of an ink jet printer head, known from PCT specification WO 89/03768. Reference is directed to this PCT specification for further background information concerning ink jet printers.

Figure 1:
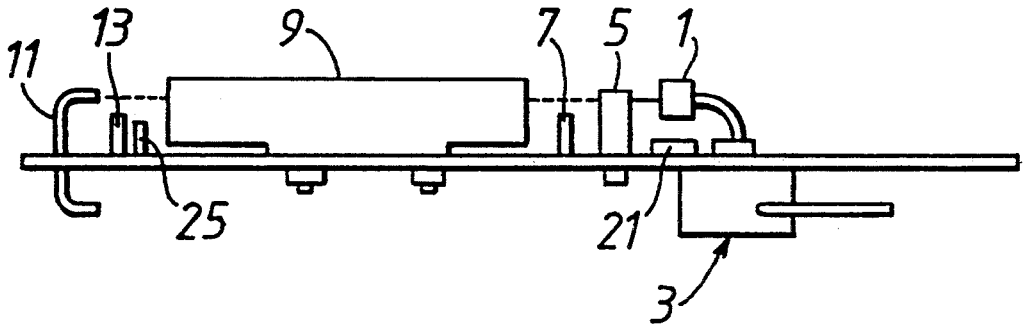
FIG. 1 (PRIOR ART)
FIG. 1 is a side view of the operative components of a known ink jet printer head.
Figure 2:
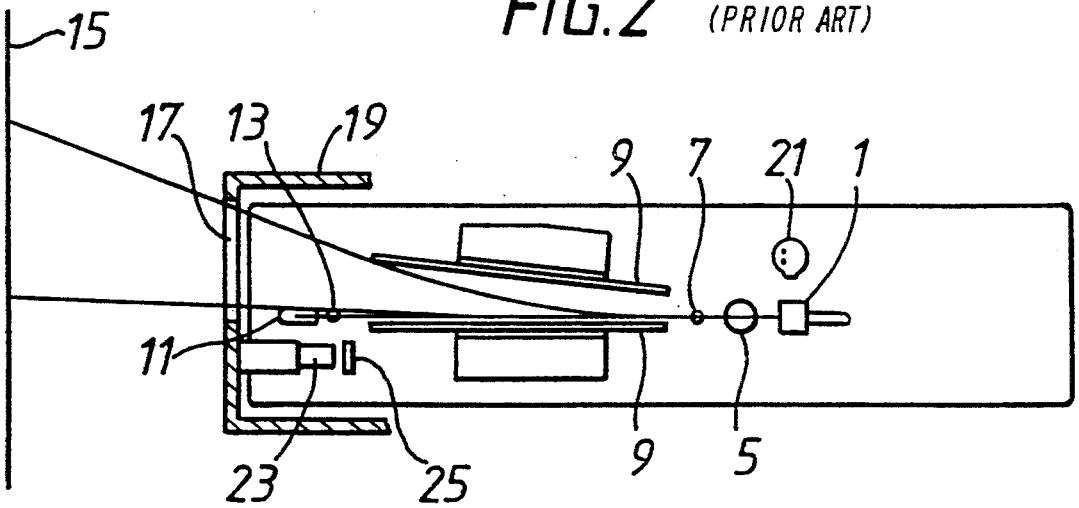
FIG. 2 (PRIOR ART)
FIG. 2 is a plan view of the print head components of FIG. 1, together with part of a print head cover and a record medium.

In the arrangement of FIGS. 1 and 2, a continuous ink jet is ejected from a nozzle 1 of an ink gun 3. The ink jet breaks into drops as it passes through an aperture in a charge electrode 5, with the result that each ink drop is charged to a level determined by the potential of the charge electrode 5 at the instant when the respective drop breaks from the ink jet. The drops pass over a charge detector electrode 7, and then pass between two deflection electrodes 9, which have a potential difference between them of several kilovolts, so as to provide a deflection field. Uncharged ink drops are not deflected by the deflection field, and pass into a gutter 11, to be returned to the ink system of the printer, having passed over a time-of-flight detector electrode 13.

In order to print onto a record medium 15, an appropriate charge is placed onto selected ink drops. A minimally charged drop will be deflected by the deflection field just sufficiently to miss the gutter 11 and a maximally charged ink drop will be deflected so as almost to strike the deflection electrode 9 towards which the charged drops are deflected. The paths of the maximally and minimally charged ink drops are shown in FIG. 2. The charged ink drops pass through an aperture 17 in a cover 19 for the print head and strike the record medium 15 at positions in accordance with their degrees of deflection, which in turn are in accordance with their degrees of electric charge.

A temperature sensor 21 is provided to monitor the temperature of the print head. A magnet 23 is mounted on the print head cover 19, and its presence or absence is detected by a Hall effect sensor 25. As a safety measure, the output of the Hall effect sensor 25 is used to remove the high voltage from the deflection electrodes 9 when it is detected that the cover 19 has been removed.

As can be seen from FIG. 2, the deflection electrodes 9 are angled with respect to each other, so as to be closer to together at their ends towards the ink gun 3, and further apart at their ends towards the gutter 11. Each electrode is connected to a source of the appropriate potential. Consequently, the field between them is stronger at their ends towards the ink gun 3, but the potential drop across the air gap between them is the same for all positions along the air gap.

A first embodiment of the present invention is shown in FIG. 3. The embodiment may be incorporated in an ink jet printer, and is described with reference to charged ink drops.

In FIG. 3, a first deflection electrode 27 is connected to earth and a second deflection electrode 29 is connected to a deflection potential VD. The electrodes 27, 29 are spaced apart in a direction S and extend parallel to each other in a direction L.

A generally wedge-shaped member 31 of a dielectric material is mounted on the second deflection electrode 29 so as to extend towards the first deflection electrode 27. Accordingly, the spacing between the two electrodes 27, 29 is not wholly occupied by an air gap. Instead, the air gap between them extends from the first deflection electrode 27 to the wedge-shaped dielectric member 31, and the width of this air gap varies as a consequence of the variation in the width of the dielectric member 31.

In FIG. 3, the path of uncharged, and undeflected, ink drops is shown by solid line 33, and the path of drops charged to the maximum value used by the printer is shown by the broken line 35. As can be seen in FIG. 3, the dielectric wedge 31 is at its widest, and the air gap is at its narrowest, at the ends of the deflection electrodes 27, 29 where the ink drops enter the space between them. The edge of the dielectric member 31 then recedes, reducing its width and increasing the width of the air gap, so as to avoid being struck by the maximally deflected ink drops. The deflection field in the air gap, which is experienced by the charged ink drops, is determined by the width of the air gap and the effective potential VE at the surface of the dielectric member 31 facing the first deflection electrode 27. Both the strength of this field and the effective potential VE vary with the width of the air gap, as will now be explained.

The electrical permittivity of the dielectric wedge 31 is constant, and is greater than that of air. Consequently, the potential difference between the second deflection electrode 29, at VD, and the first deflection electrode 27, at earth, is not dropped uniformly across the distance between them. Instead, the potential is dropped preferentially across the air gap. FIG. 6 shows a graph of potential against position in the direction S, in which the electrodes are spaced. Above the graph there is shown a schematic end view of the electrodes. In the upper part of FIG. 6, there is shown by a continuous line the dielectric member 31 attached to the second deflection electrode 29, at a position close to the left hand end of FIG. 3, where the dielectric member 31 is relatively wide and the air gap is relatively narrow. The potential between the electrodes 27, 29 at this position is shown by the solid line in the graph of FIG. 6. In the upper part of FIG. 6 there is shown with a broken line the edge of the dielectric member 31 at a position close to the right hand end of FIG. 3, where the dielectric member 31 is relatively narrow and the air gap is relatively wide. The potential between the electrodes 27, 29 at this position is shown by the broken line in the graph of FIG. 6.

As can be seen from FIG. 6, the graph for V is flatter in the dielectric member 31 than it is in the air gap. This is a consequence of the higher permittivity of the dielectric member 31. This has the consequence that the potential VE at the edge of the dielectric member 31 is greater than it would be if the potential dropped uniformly from VD to zero across the distance between the second deflection electrode 29 and the first deflection electrode 27. As can be seen from FIG. 6, at different widths of the air gap both the field across it and the potential drop across it vary, with the field strength being greater and potential smaller for a narrower air gap.

FIG. 4 shows the level of the potential VE at the surface of the dielectric wedge 31 with position in the direction L along the air gap. FIG. 5 shows the electric field strength E in the air gap for positions along the air gap in the direction L. FIGS. 3, 4 and 5 share a common L axis. The graphs of FIGS. 4 and 5 ignore possible edge effects at the ends of the deflection electrodes 27, 29.

Preferably, the electric field strength E across the air gap is the maximum strength which allows a suitable safety margin below the breakdown field strength for that width of air gap, at substantially all positions along the air gap. It is also preferred that the edge of the wedge-shaped dielectric member 31 follows the path of the maximally deflected ink drops as closely as possible without the drops hitting the member 31, so that at all points along the deflection electrodes, the air gap is as narrow as possible and therefore the maximum safe deflection field is as high as possible.

If it is assumed that these two conditions are met simultaneously, the degree of deflection of a maximally charged ink drop can be determined for a position along the air gap, which in turn determines the direction of its path, and consequently the rate of change of the width of the air gap. Thus, the shape of the face of the wedge-shaped member 31 which faces the first deflection electrode 27 can be determined. However, it is then necessary to ensure that the potential VE at the edge of the dielectric member 31 is the correct value to provide the desired field across the air gap. This can be done by calculating the required width of the dielectric member between its edge facing the first deflection electrode 27 and the point where it contacts the second deflection electrode 29, at which point it will have potential VD. This in turn will determine the shape of the edge of the dielectric member 31 which contacts the second deflection electrode 29, and this edge may not be straight. As an alternative, the edge of the dielectric member 31 contacting the second deflection electrode 29 may be straight as is shown in FIG. 3, and instead the permittivity of the dielectric member 31 may be adjusted to provide the required potential VE. However, it may be difficult to manufacture a dielectric member having the required variation in permittivity, and easier to control the shape of the second deflection electrode 29 and the adjacent surface of the dielectric member 31.

The path followed by the most deflected ink drop will depend on various operational parameters of the printer, such as ink drop size, velocity, mass and drag, maximum charge level, deflection electrode potential difference, desired maximum angle of deflection or desired maximum deflection electrode length, minimum clearance between the ink drops and the edges of the air gap, the graph (which may have to be determined experimentally) of the breakdown field strength of air against gap size in the least favourable environment likely to be encountered (e.g. high humidity), and the desired safety margin for operation below the breakdown field strength, and the relative dielectric permittivities of air and the material of the dielectric member. Therefore a shape for the dielectric member 31 and a shape for the second deflection electrode 29 which is ideal for one set of operational parameters will tend not to be ideal for another set of operational parameters.

Following determination of these parameters, the shapes of the dielectric member 31 and the second deflection electrode 29 can be determined by an iterative process, as follows. Taking an initial position, speed and direction of movement for the most highly charged drop and an initial value for the width of the air gap, the maximum allowable field strength is determined, and from this the potential difference across the air gap is determined. If this potential difference is less than the potential difference between the deflection electrodes 27, 29, the width of dielectric material required to provide the correct potential difference across the air gap can be calculated from the equation:

$$C = \left[\frac{\epsilon rd}{\epsilon ra}\right] \times \left[\frac{PD(\text{elec})}{PD(\text{gap})} - 1\right] d$$

Where

C is the width of dielectric material $\epsilon$rd is the relative permittivity of the dielectric material $\epsilon$ra is the relative permittivity of air PD (elec) is the potential difference between the electrodes 27, 29

PD (gap) is the desired potential difference across the air gap d is the width of the air gap.

If the potential difference across the air gap for the maximum allowable field strength is more than the potential difference between the electrodes 27, 29, the width of the dielectric material will be zero, and the actual potential difference between the electrodes 27, 29 is the potential difference across the air gap. This will determine the actual field strength, which will be less than the maximum allowable field strength.

From the field strength in the air gap, the forces on the ink drop can be determined, and its path plotted for an incremental distance along the air gap (or alternatively for an incremental time), and the new position, speed and direction of movement for the drop is obtained. The new position of the ink drop together with the minimum spacing permitted between the ink drop and the edge of the air gap determine the new width for the air gap. Then the width of the dielectric material and the electric field strength for the new position of the drop can be determined by the process described above. The process ends when the new direction of movement of the ink drop represents the desired maximum deflection angle.

By repeating these steps, the width of the air gap and the width of the dielectric material can be determined for a succession of positions along the air gap, and the shapes of the dielectric member 31 and the second deflection electrode 27 are calculated therefrom. The first deflection electrode 27 will normally be straight and adjacent the path of an uncharged ink drop.

In performing the above iterative process it will normally be convenient to ignore distortions in the electric field caused by end effects and adjacent parts of the deflection electrodes and of the dielectric member 31. However, once the complete shapes are determined, they may be used together with finite element electrostatic field mapping software (which is itself known) to check that the actual path of the most deflected drop conforms to the desired path when end effects and the effects of adjacent parts are considered.

Figure 8:
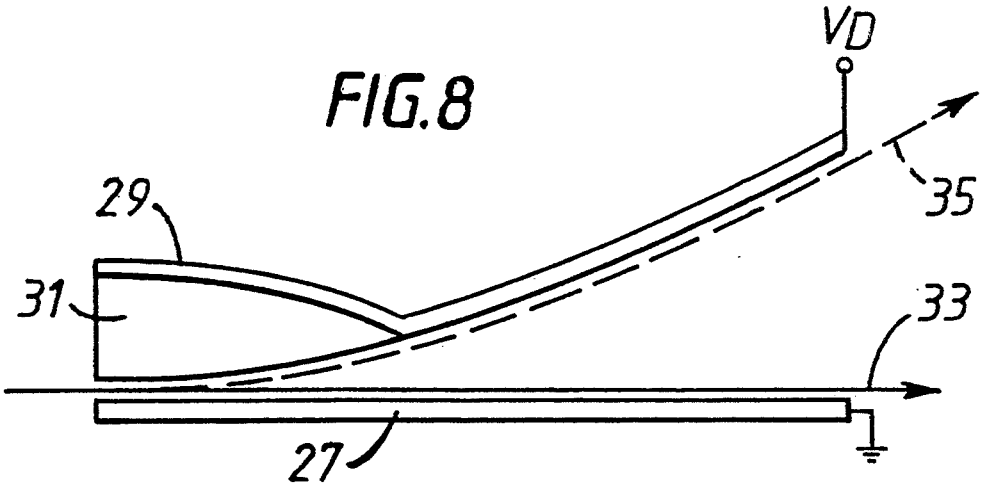
FIG. 8 shows a modification of the embodiment of FIG. 3.

As is apparent from the above-described method for determining the shapes of the dielectric member 31 and the second deflection electrode 29, there may be cases in which the dielectric member 31 does not extend over the whole length of the second deflection electrode. This will tend to happen if the desired maximum angle of deflection is relatively large while the desired potential difference between the deflection electrodes 27, 29 and the charge-to-mass ratio of the ink drops are relatively low. The desired potential difference may be limited in practice by considerations of safety, ease of circuit design, or the need to avoid breakdown of insulation in the wiring, for example. In such a case, the second deflection electrode 29 will form the edge of the air gap over a downstream portion of the air gap, and should be shaped and positioned accordingly, and the field strength in the air gap will be less than the maximum allowable in view of the breakdown field strength of air. An example of such a structure is shown schematically in FIG. 8.

FIG. 7 shows a second embodiment of the present invention. In this embodiment the variation in the potential VE across the air gap is provided by using a material of high electrical resistance as the second deflection electrode 29, connecting the deflection potential VD to its down stream end, where the air gap is widest, and connecting its up stream end, where the air gap is narrowest, to earth via a suitable resistor 37. The relative values of the resistance of the resistor 37 and the resistance of the second deflection electrode 29 between its two ends determines the potential at the up stream end of the second deflection electrode 29, and the potential of the second deflection electrode 29 will vary along its length between this value and VD.

The construction of FIG. 7 is simple, but unless all the resistances involved are extremely high there will be a significant current flow through the second deflection electrode 29. This will tend to heat the electrode and also the resistor 37, and additionally it may be difficult to provide the necessary current output from the high voltage generator which generates the deflection voltage VD.

In FIGS. 3 and 7, the first deflection electrode 27 has been described as being at earth potential. However, this is not essential, and the deflection electrodes may, for example, be one at a positive potential and one at a negative potential. Other arrangements are possible, provided that there is an electric field between them.

The illustrated embodiments of the present invention enable a high deflection field to be maintained at all positions along the air gap between the deflection electrodes, and in particular at the up stream end of the air gap. This separates the different paths for differently charged particles more quickly, and so the electrostatic and aerodynamic effects of successive particles on each other are reduced, since successive particles typically have different charges and follow different paths. Because the particles are deflected by a stronger field, a shorter charged particle flight path is required for a given raster height of the deflection apparatus, which reduces the extent to which the particles are likely to deviate from their ideal paths. Both of these factors are likely to improve the print quality in the case of an ink jet printer. Additionally, the reduction in the electrostatic and aerodynamic interference between nearby drops can in some circumstances permit a reduction in the number of guard drops used between printing drops in an ink jet printer or analogous device, which will enable faster printing operation by the printer.

Although the present embodiments have been described in terms of modifications to the print head of FIGS. 1 and 2, it may be found in practice that print quality is improved by angling the line of the ink jet relative to the record medium 15 onto which the ink is printed, so as to shorten the path of the most deflected drops. It should be noted that this angling alters the relationship between angle of deflection and printed dot spacing on the record medium 15. There may also be constructional benefits in arranging the plane of deflection transverse to the plane of the support on which the print head components are mounted. In particular, the first deflection electrode 27 can be formed directly on the support.

Various modifications and alternative constructions will be apparent to those skilled in the art. Although the invention has been described with reference to ink jet printers, it will be apparent to those skilled in the art that it may be used in the deflection of other charged particles.

Although the invention has been described on the basis that the gaseous medium through which the charged particles move is air, other gaseous media may be used. For example, special gaseous media may be used for safety or sterility in some circumstances under which the invention is used. Accordingly the term "air gap" as used herein should not be regarded as implying that the gaseous medium is air, but instead the term "air gap" refers to a gap in which a gaseous medium is present.

I claim:

1. A deflection system for deflecting charged particles comprising first and second deflection electrodes having an air gap between them for passage of said charged particles therealong in a predetermined direction, means for applying respective voltages to said first and second deflection electrodes so as to provide an electric potential difference across said air gap and thereby to provide an electric field in said air gap, the electric potential difference across said air gap and the width of said air gap both varying with distance along said air gap in said predetermined direction over at least a part of said distance, thereby defining first and second positions along said air gap at first and second distances along said predetermined direction such that the electric potential difference across said air gap is smaller, and the width of said air gap is smaller, at said first position along said air gap than at said second position along said air gap.

2. A deflection system according to claim 1 which further comprises a dielectric member between the first and second deflection electrodes, said air gap being present between the dielectric member and one of the deflection electrodes.

3. A deflection system according to claim 2 in which the edge of the dielectric member remote from the air gap is not straight, and contacts the other deflection electrode.

4. A deflection system according to claim 1 in which one of the deflection electrodes has a potential gradient along it.

5. A deflection system according to claim 1 in which said electric field in said air gap is stronger at said first position than at said second position.

6. A deflection system for deflecting charged particles comprising first and second deflection electrodes and a dielectric member between them, arranged to provide an air gap between the dielectric member and one of the deflection electrodes, the thickness of the dielectric member varying with distance along said air gap.

7. A deflection system according to claim 6 in which respective electric potentials are applied to said first and second deflection electrodes, and the consequent electric potential at the surface of the dielectric member nearest to said air gap varies with distance along said air gap.

8. A deflection system according to claim 6 in which respective voltages are applied to said first and second deflection electrodes thereby to generate an electric field across said air gap, and the strength of said electric field varies with distance along said air gap.

9. A deflection system according to claim 6 in which the side of the dielectric member remote from the air gap contacts the other deflection electrode, and the surface of contact is curved.

* * * * *